US007156041B2

(12) United States Patent
Degenkamp

(10) Patent No.: US 7,156,041 B2
(45) Date of Patent: Jan. 2, 2007

(54) ANCHOR COMPRISING A SHANK

(75) Inventor: Gijsbertus Degenkamp, Ea Voorburg (NL)

(73) Assignee: Vrijhof Ankers Beheer B.V., Aan de Ijssel (NL)

( * ) Notice: Subject to any disclaimer, the term of this patent is extended or adjusted under 35 U.S.C. 154(b) by 0 days.

(21) Appl. No.: 11/131,801

(22) Filed: May 18, 2005

(65) Prior Publication Data

US 2005/0211151 A1 Sep. 29, 2005

Related U.S. Application Data

(60) Division of application No. 10/272,438, filed on Oct. 16, 2002, now Pat. No. 6,901,878, which is a continuation of application No. PCT/NL01/00325, filed on Apr. 27, 2001.

(30) Foreign Application Priority Data

Apr. 27, 2000 (NL) ..... 1015034

(51) Int. Cl.
*B63B 21/24* (2006.01)

(52) U.S. Cl. ..... 114/303

(58) Field of Classification Search ..... 114/304, 114/303, 309

See application file for complete search history.

(56) References Cited

U.S. PATENT DOCUMENTS 3,774,569 A * 11/1973 Linnenbank ..... 114/303
4,577,581 A 3/1986 Puech
4,995,326 A 2/1991 Van Den Haak
5,353,732 A * 10/1994 Gramet et al. ..... 114/304
5,474,015 A 12/1995 Bruce
5,640,921 A 6/1997 Van Den Haak et al.
6,082,284 A 7/2000 McCabe

FOREIGN PATENT DOCUMENTS

| | | |
|---|---|---|
| DE | 242975 | 1/1912 |
| EP | 0 049 544 | 9/1981 |
| GB | 1 553 080 | 9/1979 |
| NL | 7 115 016 | 5/1973 |
| NL | 9 001 315 | 1/1992 |

* cited by examiner

*Primary Examiner*—Stephen Avila
(74) *Attorney, Agent, or Firm*—Ladas and Parry LLP

(57) ABSTRACT

Anchor comprising a fluke and a shank which at a first end is attached to the fluke and a second end that is situated opposite to the first end, is provided with means for attachments of the anchor to a penetration line or anchor line, in which the shank comprises two shank legs, which at the second end are connected to each other using a pin, in which the portion of the pin situated within the shank legs also serves as connection means for an end link or end shackle of the penetration line or anchor line.

26 Claims, 8 Drawing Sheets

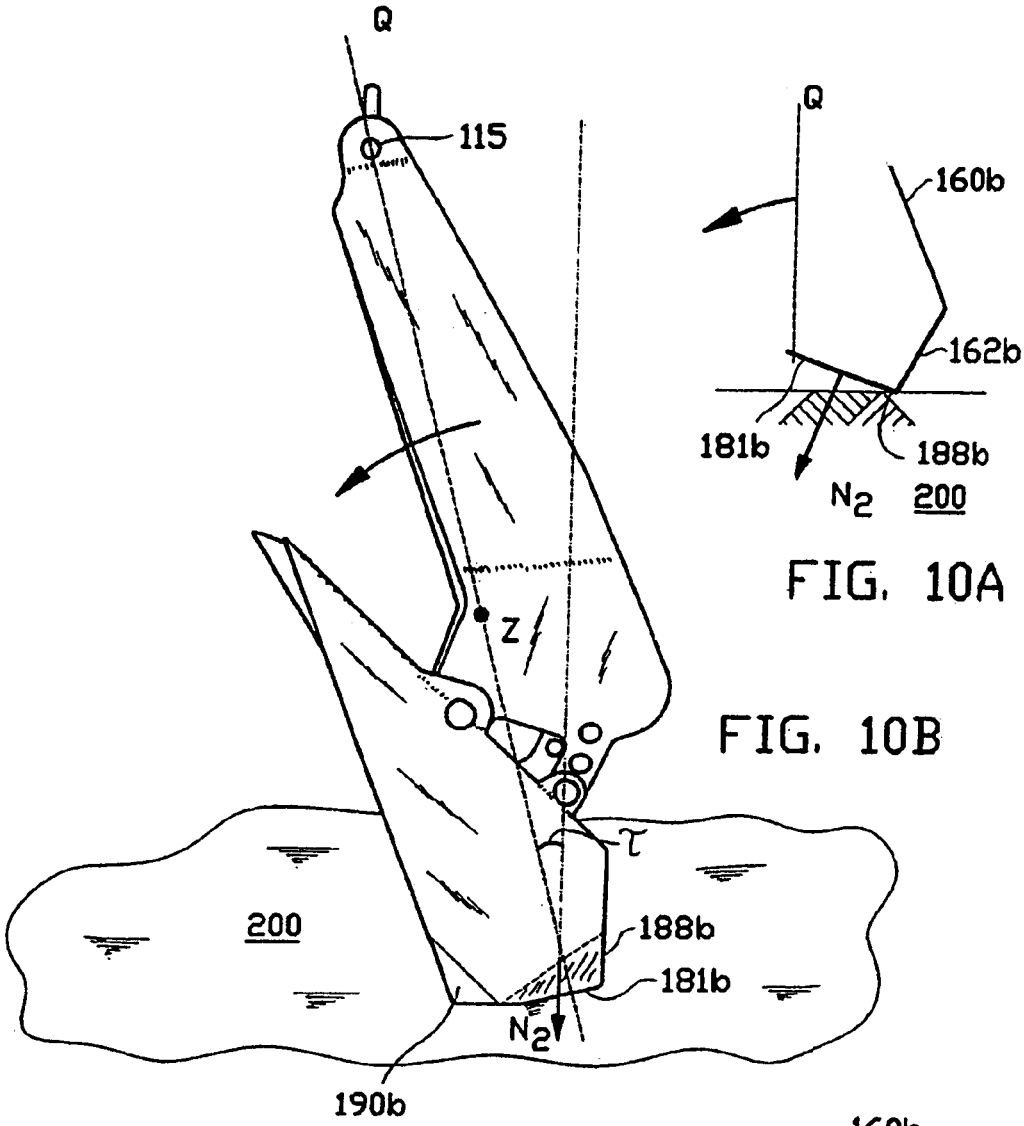
FIG. 10A
FIG. 10B
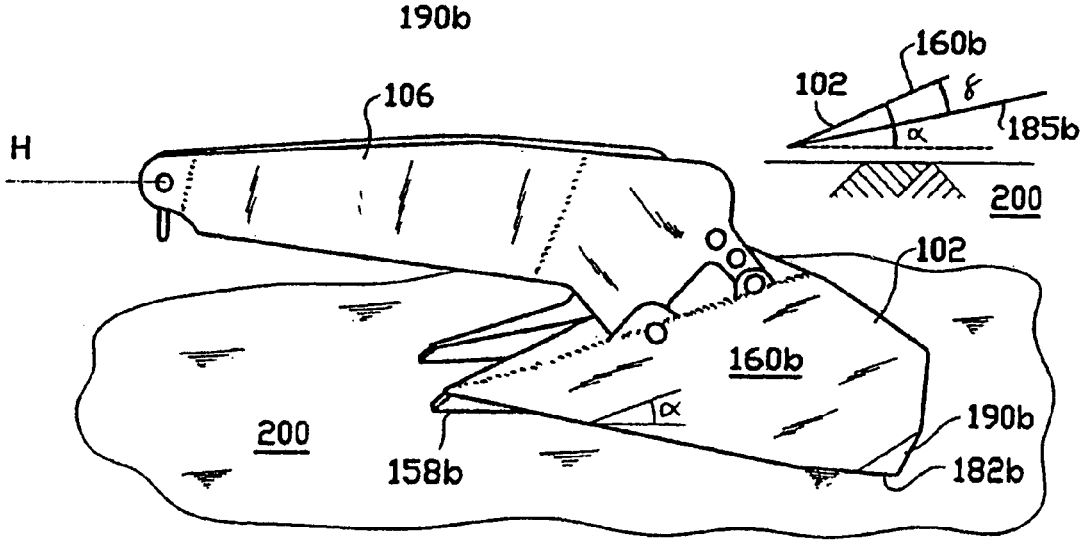
FIG. 11

ANCHOR COMPRISING A SHANK

This is a divisional of application Ser. No. 10/272,438 filed on Oct. 16, 2002 now U.S. Pat. No. 6,901,878 which is a continuation of International Application PCT/NL01/00325 filed on Apr. 27, 2001, which designated the U.S., claims the benefit thereof and incorporates the same by reference.

The invention relates to an anchor comprising a fluke and a shank. The shank of the anchor at one end is attached to the fluke and at the opposite other end provided with means for attachment to an anchor line or the like. The shank here ensures the transfer of the tensile forces in the anchor line to the fluke, particularly during penetrating the anchor in the anchoring soil, but possibly also during anchoring of an object connected to the anchor, such as a semi-submersible.

An example of such an anchor that has proven to be able to function well under normal conditions is applicant's Stevpris® anchor, which among others is subject of European patent 0.049.455. The Stevpris anchor has a shank having plate-shaped legs converging away from the fluke.

In the penetrated situation of the anchors it may occur that they are loaded with a force that has a component transverse to the shank. Said transverse force will have to be accommodated by the shank. Furthermore—even very large—transverse forces can be exerted on the shanks when the anchor is hauled in and is hauled in then with the shank forward over the roll on the deck of an auxiliary or supply vessel. It often occurs then that—instead of with one of the shank's rear edges—the anchor comes to support on the roll with one shank leg, that means rotated a quarter of a turn. As a result considerable deformations may occur in the shank of the anchor, which may even lead to the anchor needing a new shank.

It is an object of the invention to provide a simply constructed anchor that improves on this. To that end the invention provides an anchor comprising a fluke and a shank, which at a first end is attached to the fluke and at a second end that is situated opposite to the first end, is provided with means for attachment of the anchor to a penetration line or anchor line, in which the shank comprises two shank legs, which at the second end are connected to each other using a first pin, in which the portion of the pin situated within the shank legs or their continuation also serves as connection means for an end link or end shackle of the penetration line or anchor line.

In the anchor according to the invention the pin not only has the function of direct or indirect connection means of the shank legs at their second end, but it can also cooperate in the fixing of the distance one to the other between the shank legs at that location, and of means for attaching the anchor line. By keeping the shank legs at a distance a broad support is realised and the moment of resistance W of the shank is increased and deformation under the occurring moments and transverse forces are better counteracted. The location of the end link of the anchor line between the shank legs renders the outside of the second end smooth, as a result of which movement of the second shank end over a roll is improved.

Preferably the end link is formed like a so-called bow-shackle, in which it is particularly advantageous when the pin is also part of the bow-shackle. In the latter case parts are further economized on. The bow of the bow-shackle falls between the shank legs and as a result in principle has a larger freedom of rotation.

Preferably the end link is connected in a rotatable manner to the pin, so that an optimal transfer of forces can always take place. The rotation will take place here within the shank legs, and as a result need not be impeded.

Preferably the first pin is fixedly attached to the shank legs, so that it is ruled out that the pin can become detached during said rotation.

Alternatively the pin can be axially secured in holes in the shank legs, but can still be rotatable, and the bow-shackle can be fittingly accommodated between the legs, in which case the bow-shackle impedes the movement towards each other of the shank legs, and the securing of the pin to the outside of the shank legs prevents a moving away from each other of the shank legs.

In a further development of the anchor according to the invention, the first pin is provided with means for connection to the end of an added pennant line. The first pin thus has an extra function, namely the transfer of tensile forces to the shank of the two lines, namely the anchor line and the pennant line. The pennant line connection is also somewhat shielded here.

The anchor may be provided with a second pin that is movably connected to the first pin and serves as connection means for an added pennant line. It is preferred here that the second pin is connected to the first pin by means of a rigid connection member. The distance between both pins then remains constant.

In case the rigid connection member can be rotated about the centre line of the first pin, the connection member can swing down along with the second pin during penetration of the shank in the anchoring soil, and swing upwards when the second pin is being used.

Preferably the rigid connection member has a width that is smaller than the distance between the shank legs at the second end of the shank. The connection member can thus fall within the profile of the shank, as a result of which damage of the anchor shank and the surroundings during anchor handling can be counteracted.

Preferably the second pin is also part of a bow-shackle, which is preferably connected in a rotatable manner to the connection member, so that when exerting tension on the pennant line the shackle and the connection member will come to lie in one line of force.

It is further preferred that the second pin has a length that is smaller than the distance between the shank legs at the second end of the shank. The second pin as well can thus fall within the profile of the shank, as a result of which damage of the anchor shank and surroundings during anchor handling is further counteracted.

Fitting within the shank after swinging is ensured when the connection member and the second pin have been secured with respect to the first pin against movement along its centre line.

In an alternative development of the anchor according to the invention, at the second end a second pin extends between the shank legs and is secured to it, rearward of the first pin, as connection means for an added pennant line, and preferably is part of a bow-shackle that also extends between the shank legs.

Preferably the shank legs are plate-shaped. It is further preferred that near the first end the shank legs are situated in parallel planes, so that the distance between the plates there is constant, and therefore equal at the first pin and the location or swing track of the second pin.

From a further aspect the invention provides an anchor comprising a fluke and a shank extending upwards and forward from the fluke, which shank at a first end is attached to the fluke and at a second end that is situated opposite to the first end, is provided with means for attachment of the anchor to a penetration line or anchor line, in which the shank is rigid and the fluke at the lower side is provided with lower surfaces for supporting the lower side of the fluke according to a support surface, in which the shank extends to the second end substantially parallel to the support surface. This is advantageous for the initial penetrating of the fluke in the anchoring soil, but also advantageous when storing the anchor on board of a supply vessel and when preparing the anchor, in particular the second end of the shank, at that location.

Preferably the shank comprises two cranked shank legs that converge to the second end.

It is preferred then that the fluke has an upper surface, which at the front considered in a vertical longitudinal sectional plane is at an angle of approximately 10–30°, preferably 20–30°, preferably approximately 25°, to the support surface. As a result the penetration characteristics of the fluke are improved.

From a further aspect the invention provides an anchor comprising a fluke and a shank extending upwards and forward from the fluke, which shank at a first end is attached to the fluke and at a second end that is situated opposite to the first end, is provided with means for attachment of the anchor to a penetration line or anchor line, in which the shank is rigid and comprises two shank legs, in which the fluke has an upper surface which at the location of the first end of the shank forms a substantially planar plane, that is perpendicular to a longitudinal plane of symmetry of the anchor and preferably is continuous from the front edge to the rear edge, in which the upper surface of the fluke outside of the shank legs forms planes that run oblique to the side and downwards. As a result the passage of soil by the shank is improved whereas the space underneath the fluke is shielded to the side, as a result of which parts situated there, such as in case of an adjustable shank its adjustment lip, get damaged less quickly. The planes of the fluke running obliquely to the side, moreover improve the passage of the anchor over the roll of a supply vessel. Furthermore the stability during penetration is improved.

Preferably the fluke forms a hollow body (box) having a lower surface which in the area underneath the said planar plane of the upper surface comprises two planes that incline sideward and downward and meet each other according to a top line that is situated in a longitudinal plane of symmetry of the anchor. As a result the cross-section in transverse direction of the fluke corresponds to the line of moments, in which a small height is present in the middle, where—considered in cross-section—the smallest moments as a result of the soil pressure are present, but a larger height at the location of the attachment of the shank legs. Nonetheless the passage of the soil over the shank, between the shank legs, is impeded as little as possible because at that location the upper surface is as straight and therefore as small as possible.

Preferably the lower surface of the fluke is continued to the side, up to the side edges in planes running obliquely downward, as a result of which the directional stability is further improved, and also the—hollow—fluke construction can remain simple.

Considered in a sectional plane perpendicular to the longitudinal plane of symmetry, the fluke preferably has an inverted V-shape.

From a next aspect the invention provides an anchor comprising a fluke and a rigid shank during use extending upwards and forward from the fluke, which shank at a first end is attached to the fluke and at a second end that is situated opposite to the first end, is provided with means for attachment of the anchor to a penetration line or anchor line, in which the fluke forms a hollow body of plates and has an upper surface and a lower surface, which from front to rear diverge with respect to each other, considered in a longitudinal sectional plane, to a rear side of the fluke, in which the anchor has a reference line running through the centre of gravity of the anchor and through the point of force application of the penetration line on the second end of the shank, in which the rear side of the fluke at the lower side is provided with transverse edges, that are situated rearward from the reference line. When the anchor comes down, pending with the reference line vertically, it will first come down on the transverse edges. Because of the rearward position of the transverse edges, the anchor will be inclined to tilt forward from an initially instable orientation, to a correct position for penetration.

Preferably the transverse edges are situated on both sides of the longitudinal plane of symmetry of the anchor and are in line with each other, so that a kind of rotation or tilting edge is obtained at the rear side of the fluke.

Preferably the transverse edges form the rear boundary of support surfaces that are part of the lower surface of the fluke, of which surfaces the opposite of the normal is at an angle to the reference line, which angle opens in rearward direction of the anchor. The rear side of the fluke forms support surfaces, of which the opposite of the normal is at an acute angle to the reference line, which opens in rearward direction of the anchor. In this way it is achieved that the anchor after coming down on the transverse edges does not sink too deeply into the bottom and otherwise impeding the tilting process.

Preferably the support surfaces are situated on both sides of the longitudinal plane of symmetry of the anchor, particularly at a distance from the longitudinal plane of symmetry, preferably contiguous to the side edges of the fluke, as a result of which the fluke when coming down on the anchoring bottom—considered in transverse direction—can first take up a stable position before tilting forward. The distance between the support surfaces moreover offers more possibilities for realising soil flow improving provisions on the fluke, such as for instance the V-shaped tunnel at the lower side of the fluke mentioned earlier.

From a further aspect according to the invention it is provided that the fluke forms a hollow body of plates and has an upper surface and a lower surface, which from front to rear diverge with respect to each other, considered in a longitudinal sectional plane, to a rear side of the fluke, in which the rear side of the fluke forms planes, which are oriented obliquely rearward and upward when the fluke is placed on a level base. In this way the soil flow over the rear side of the fluke is improved.

From a next aspect it is provided according to the invention that the fluke forms a hollow body of plates and has an upper surface and a lower surface, which from front to rear diverge with respect to each other, considered in a longitudinal sectional plane, to a rear side of the fluke, in which the shank is rigid and comprises two shank legs that are attached at the first end to two longitudinal girders in the fluke, which longitudinal girders each comprise two parallel strip-shaped plates, which between them define an accommodation space for an attachment lip at the first end of the shank legs, in which the strip-shaped plates extend from the front edge of the fluke to the rear edge. Said longitudinal girders are a part of the structure of the fluke. Because of its continuous double design the solidity is increased, and more mounting possibilities are also provided, such as for penetration points and for the front parts of the first end of the shank legs.

Preferably at least in a front portion the strip-shaped plates are connected to each other by means of a steel transverse strip. As a result both longitudinal strips are counteracted to deform towards each other. With the upper surface a kind of box girder can be formed as a result of which the strength is improved. The front ends of the box girders moreover form a suitable accommodation space for the penetration points.

From a further aspect the invention provides an anchor, in which the fluke forms a hollow body of plates and has an upper surface and a lower surface, which from front to rear diverge with respect to each other, considered in a longitudinal sectional plane, to a rear side of the fluke, in which in the outermost laterally situated areas of the fluke side planes have been formed having a normal that is substantially perpendicular to a longitudinal plane of symmetry of the anchor. As a result damage of the fluke or its surroundings during handling is counteracted.

It is preferred here that contiguous to the side planes stabiliser planes that are obliquely inwardly and downwardly oriented have been formed in the lower surface of the fluke. Said plates are reinforced by the side planes.

The invention will be elucidated on the basis of the exemplary embodiment shown in the attached drawings, in which.

Figure 6:
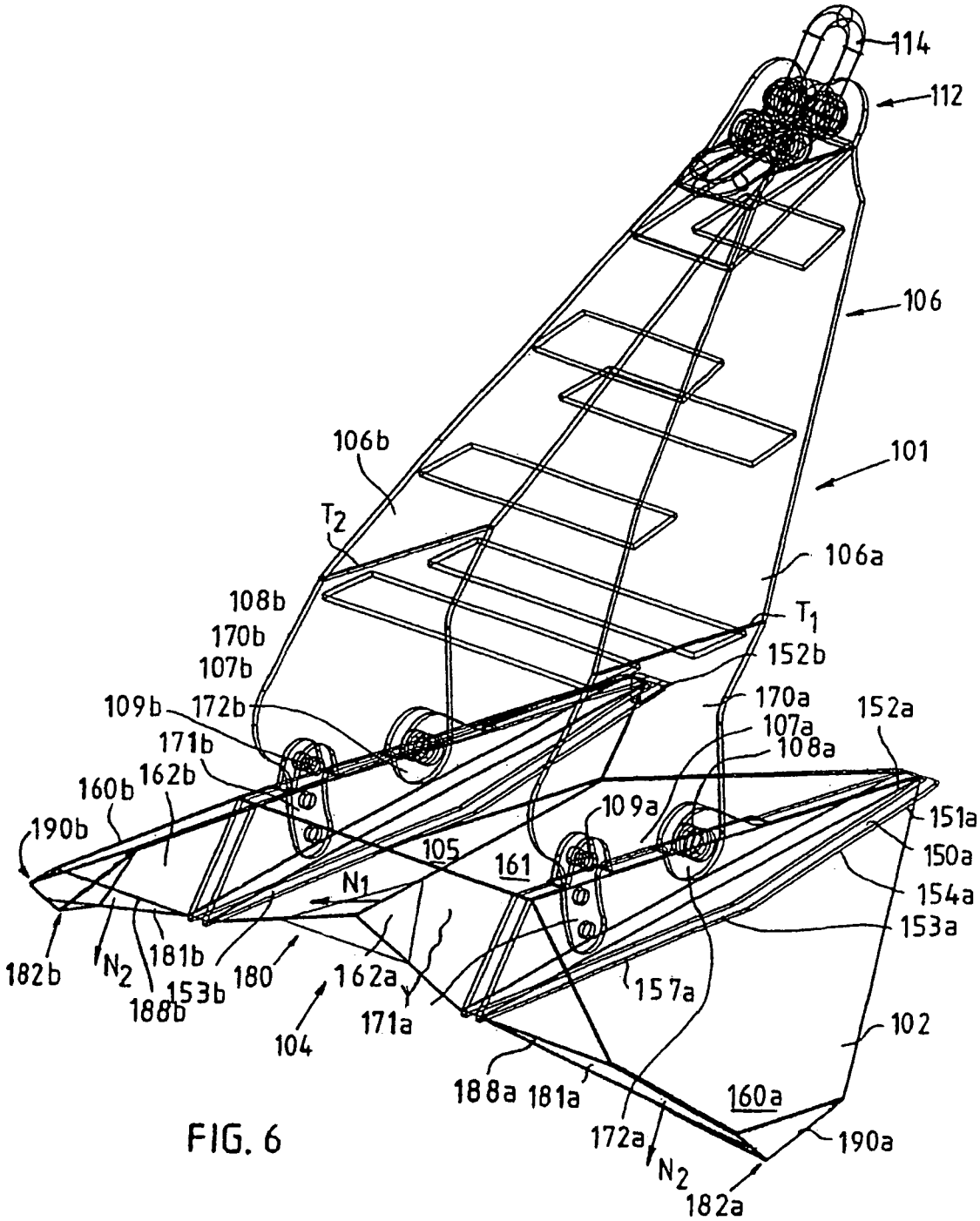
FIG. 6 shows a transparent view in perspective on another anchor according to the invention.
Figure 7A:
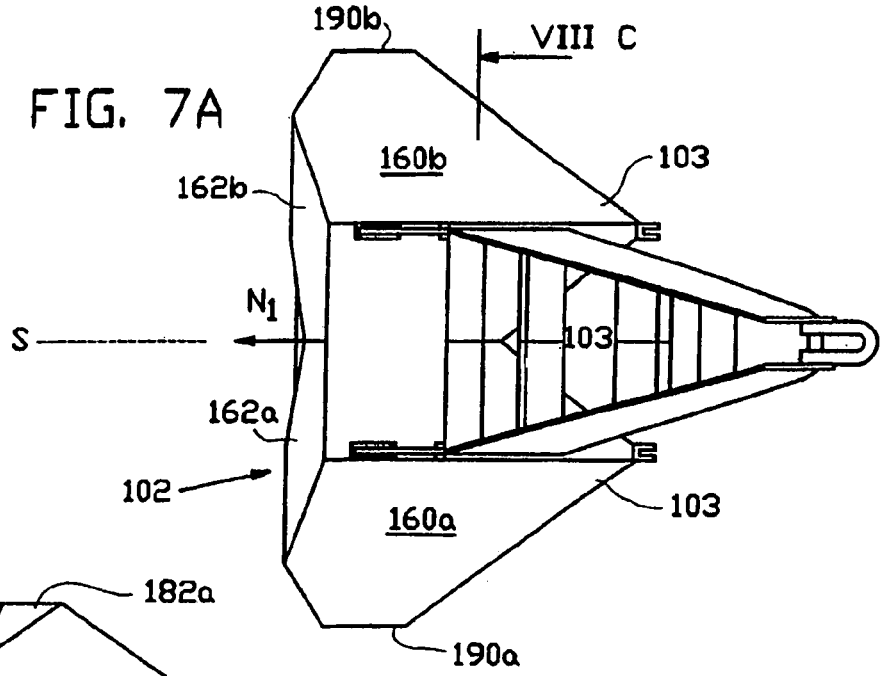
Figure 7B:
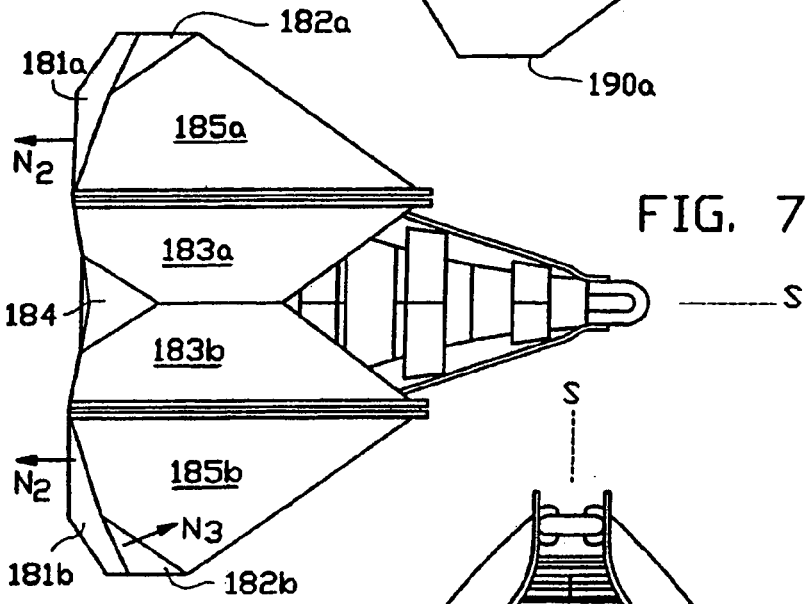
Figure 7C:
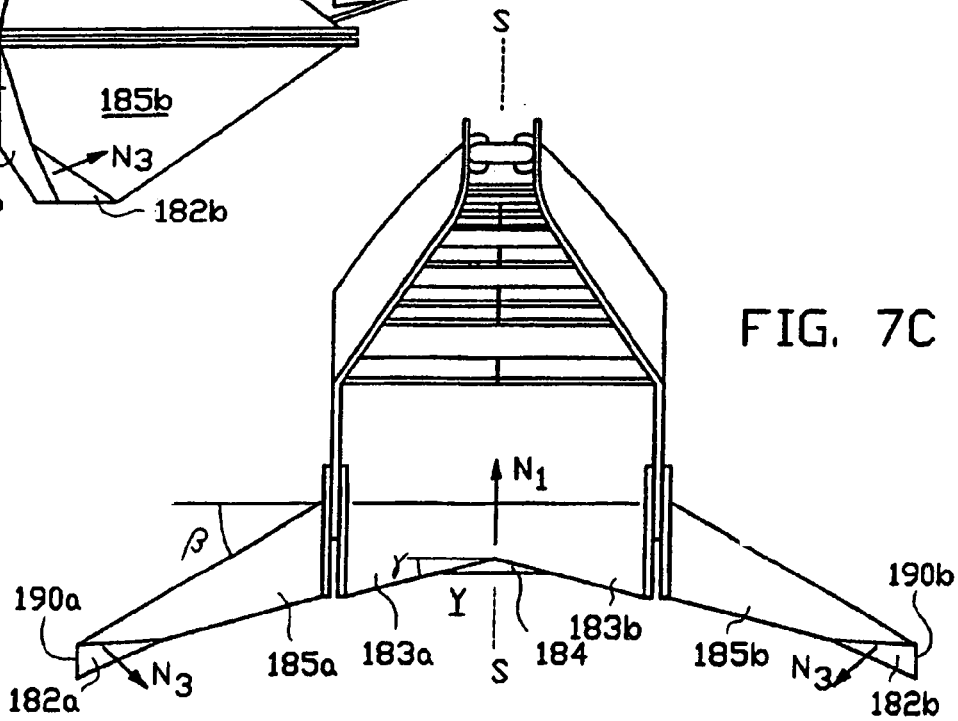
Figure 8:
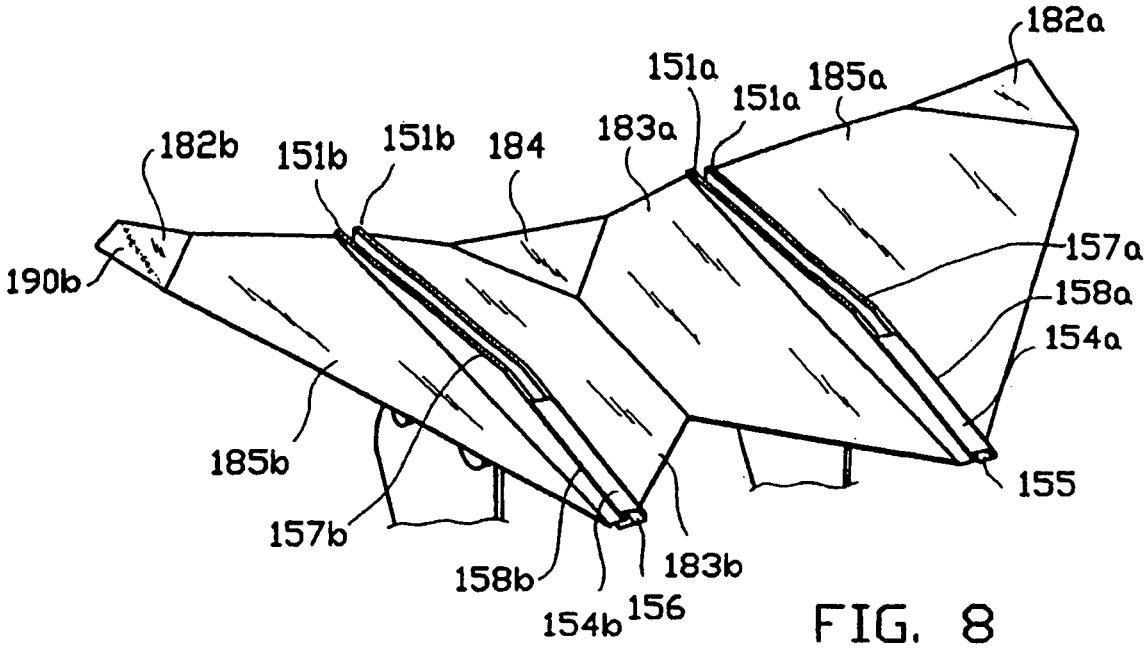
Figure 9:
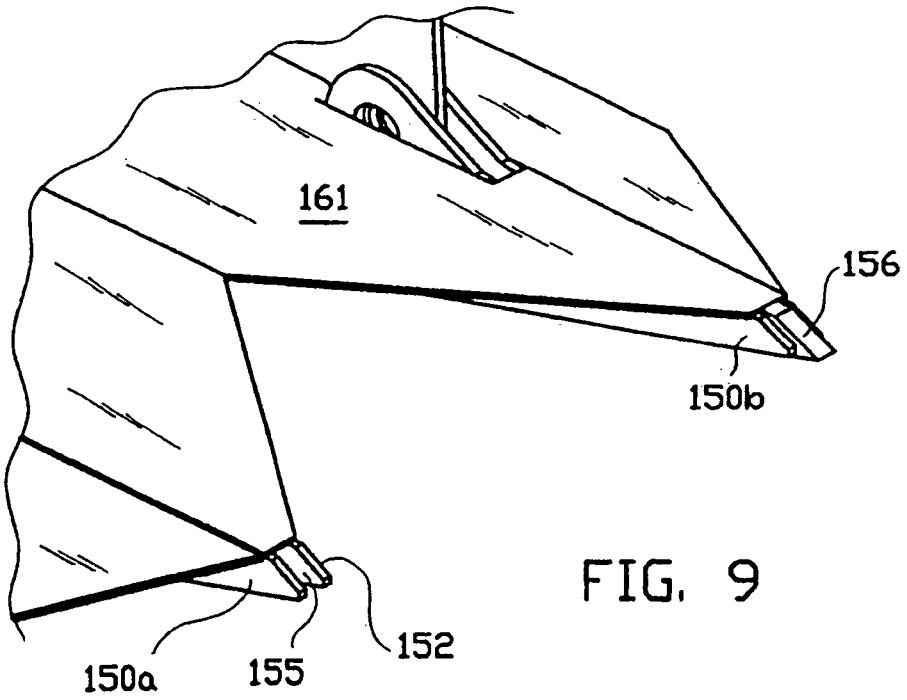

FIGS. 7A–C show a top view, a bottom view and a cross-section according to arrow VIIIC, respectively, of the anchor of FIG. 6;

FIG. 8 shows a view in perspective of the bottom side of the fluke of the anchor of FIG. 6;

FIG. 9 shows a view obliquely from above of the front edge of the anchor of FIG. 6;

FIG. 10A shows a detail of the rear side of the fluke of the anchor of FIG. 6, at the moment of coming down on an anchoring bottom;

FIG. 10B shows the anchor of FIG. 6, shortly after the situation of FIG. 10A; and FIG. 11 shows the anchor of FIG. 6, in a position ready for penetration in an anchoring bottom.

Figure 1:
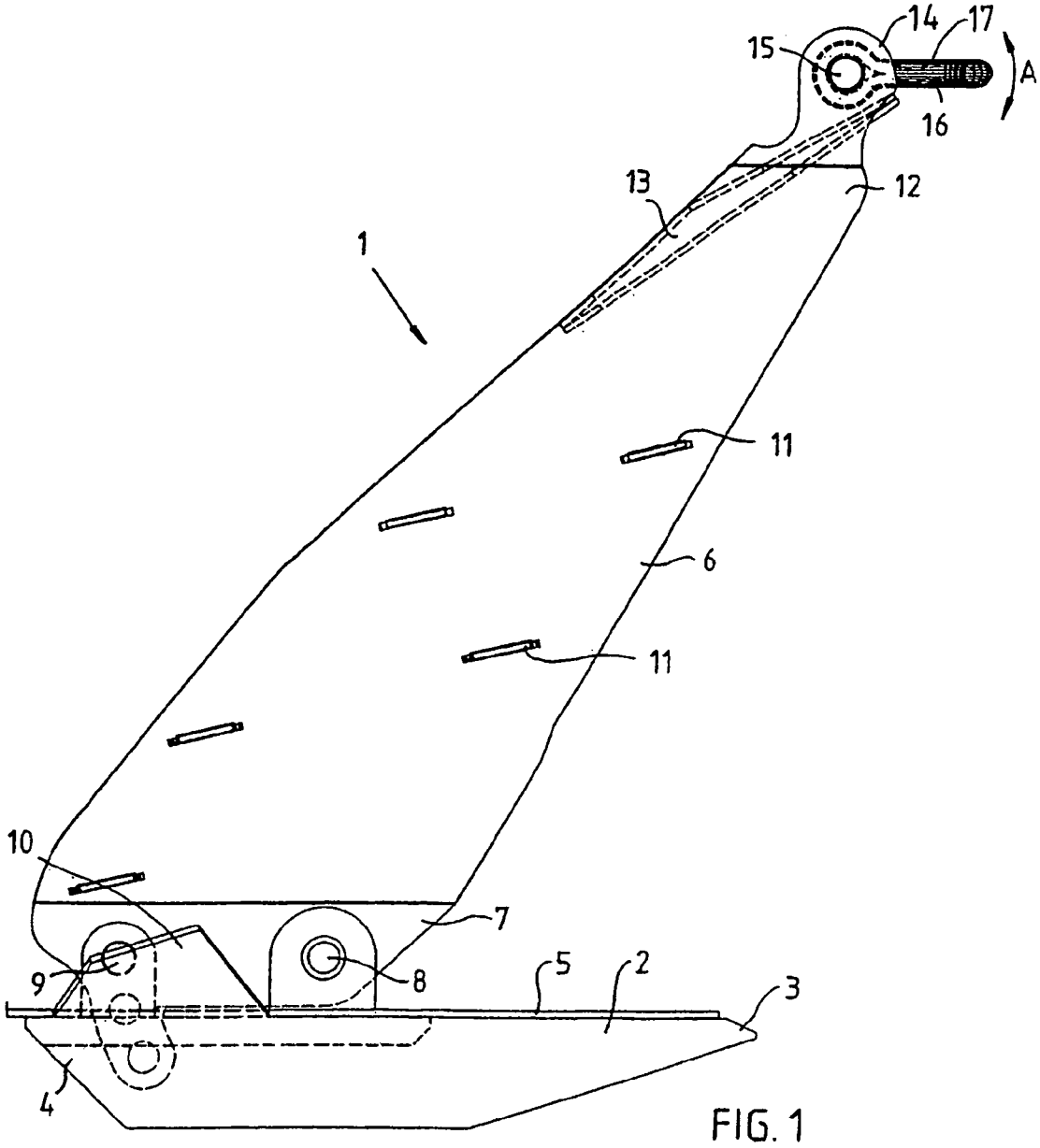
FIG. 1 shows a side view of an anchor according to the invention.
Figure 2:
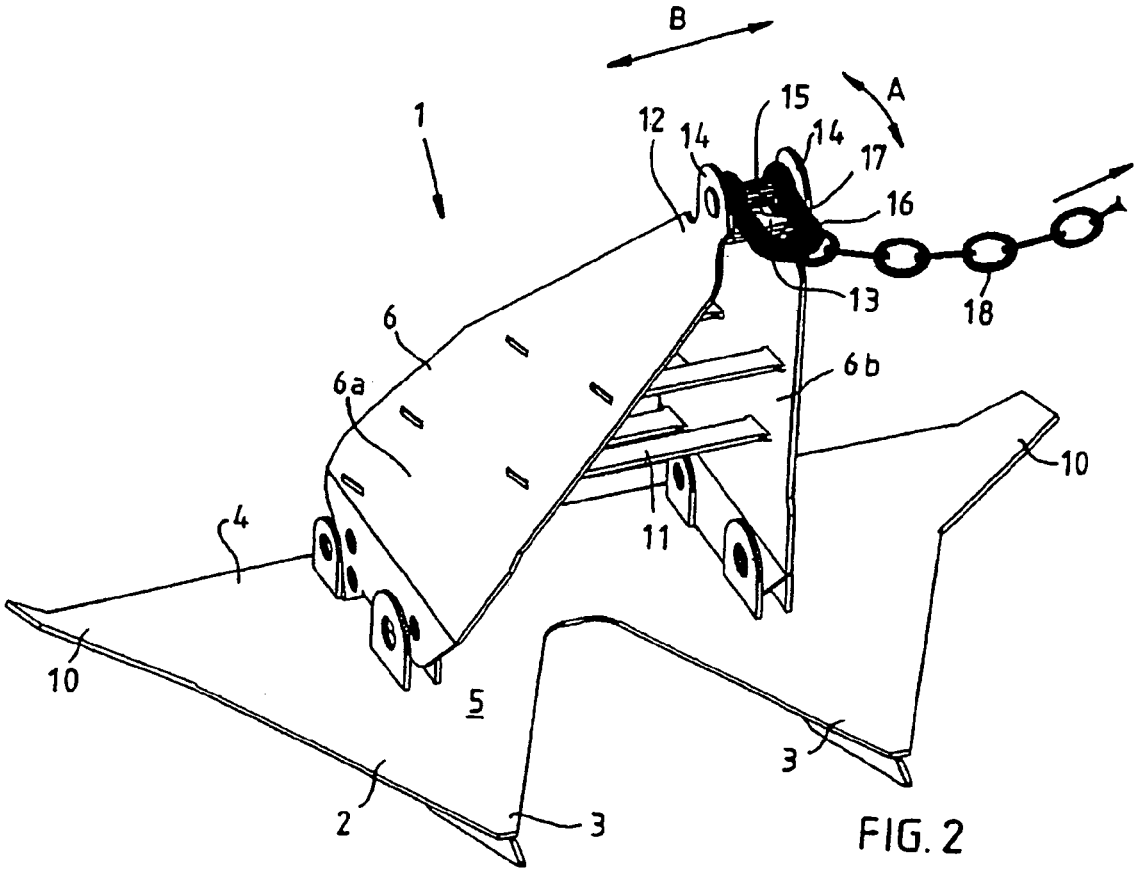
FIG. 2 shows a view in perspective of the anchor of FIG. 1.

The anchor 1 in the FIGS. 1 and 2 comprises a fluke 2 having an upper surface 5, a front end 3 and a rear end 4, and a shank 6 of two plate-shaped shank legs 6*a, b* which at their lower end 7 are hingingly connected by means of pins 8 to the fluke 2 and by means of lips and pins 9 provided with several holes (for adjustment of the angle between the fluke and the shank) at a location situated behind it to the fluke 2.

The shank legs 6*a,b* are connected to each other along their length by means of transverse plates 11. At their upper end 12 the shank legs 6*a, b* are formed with end ears 14, to which—in this example—a (first) pin 15 is fixedly attached with its ends, for instance by welding of by means of threading. The pin 15 is a part of a bow-shackle 16, of which the U-bow 17 is freely rotatable—in the directions A—about the pin 15. The pin 15 keeps the ears 14 spaced apart, in which the resistance from the shank 6 against bending in the directions B is increased. The U-bow 17 falls within the ears 14 and within the line X and forms an attachment for a link of the chain 18 which leads to a vessel or to an object to be anchored.

At the upper end 12 a reinforcement plate 13 has been attached between the shank legs 6*a, b*.

Figure 3:
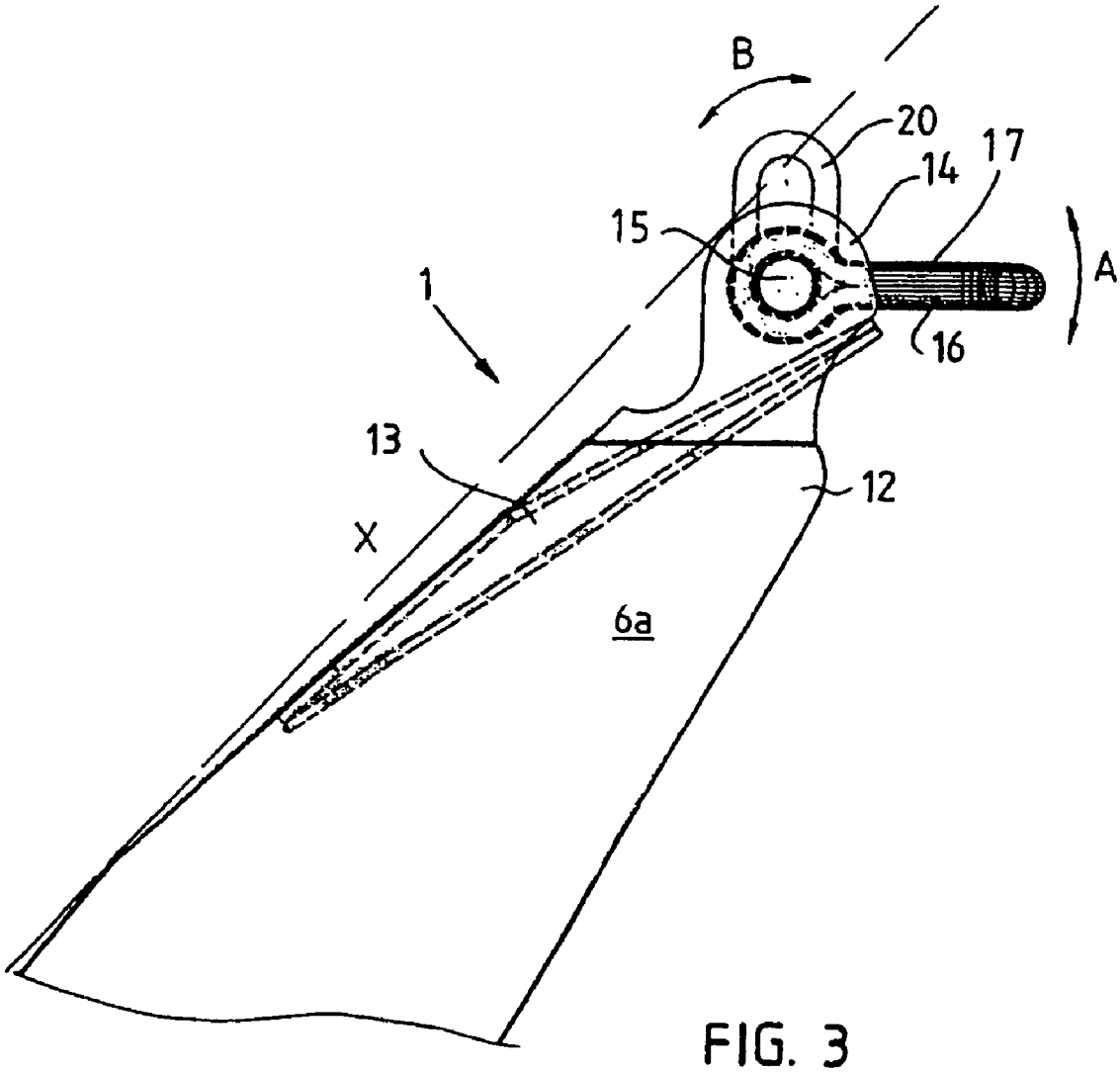
FIG. 3 shows an upper end of the shank of the anchor of FIGS. 1 and 2, having an additional shackle for a pennant line.

The upper end of the shank 6 shown in FIG. 3 differs from the one in FIG. 1 in that a second shackle or bow-shackle 20 has been arranged in an orientation transverse to the bow-shackle 16. The bow-shackle 20 is substantially parallel to the plane of symmetry S of the anchor 1, and with the help of pin 22 is confined in order to engage about the pin 15. The bow-shackle 20 can swing freely in the direction B. In the farthest anti-clockwise turned position, the bow-shackle 20 falls within the ears 14, as a result of which the shackle 20 is no impediment when pulling over the roll of a supply vessel. This also holds good when the anchor rests on the rear edge of the shank on deck or is moved over it.

Figure 4:
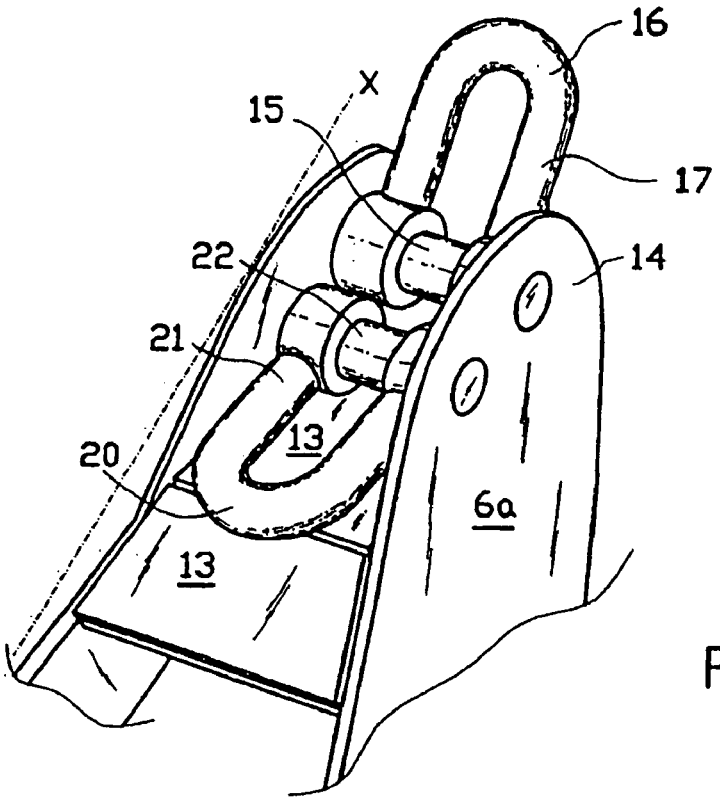
FIG. 4 shows a further possible embodiment of an upper end of a shank in an anchor according to the invention.

In FIG. 4 the second bow-shackle 20 is fixedly attached in holes in the ears 14 of the upper end of the shank 6 by pin 22. There are now two bow-shackles, namely 16 and 20, arranged in a comparable manner, which are destined for an anchoring line and a pennant line, respectively. In this case, in the supported position shown, the bow-shackle 20 remains within the line X shown in FIG. 3 and within the contour of the ears 14.

Figure 5:
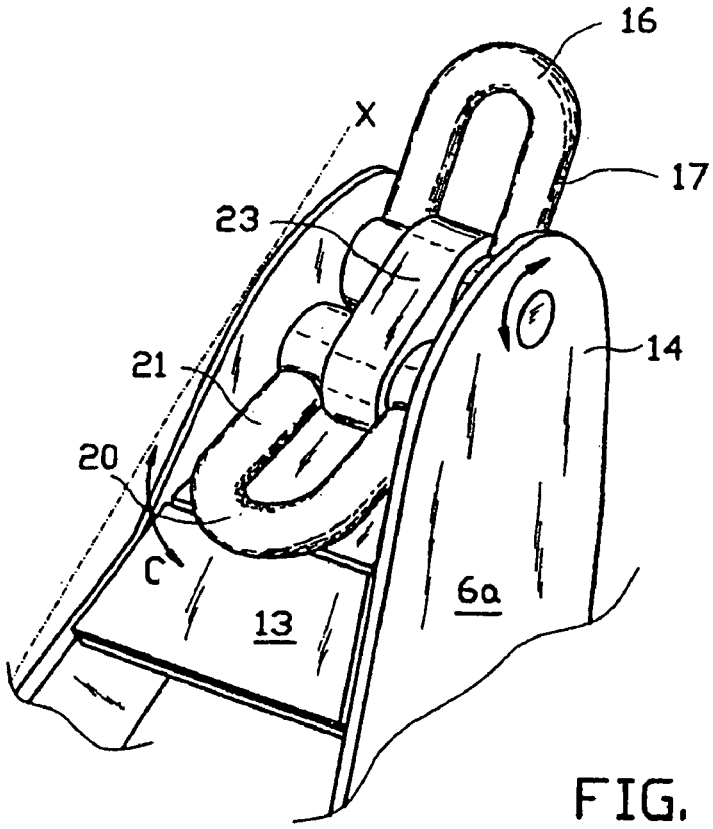
FIG. 5 shows an alternative embodiment of the upper end of a shank of an anchor according to the invention.

In FIG. 5 the second bow-shackle 20 is not directly connected to the ears 14 of the shank 6. Here use is made of a rigid connection member 23, that is provided with two parallel holes, for rotatable accommodation of the pin 15 of the first bow-shackle 16, and the pin 22 of the second bow-shackle 20, respectively. The pin 15 is fixedly attached to the ears 14, in holes 23, and the bow-shackle 20 is freely rotatable in the direction C with respect to the connection member 23, and the connection member 23 is freely rotatable in the direction D about pin 15. In this case, in the inactive position shown, the connection member 23 remains within the contour of the ears 14, and also the bow-shackle 20, as well as within the line X shown in FIG. 3. The bow-shackle 20 may if necessary be removed.

The anchor 101 in FIG. 6 and further has a fluke 102 and a shank 106, in which the fluke again has a front edge 103 and a rear edge 105.

The shank legs 106*a*, 106*b* converge in downward direction with respect to each other, up to buckle-lines T1 and T2, where they are continued in downward direction in parallel and vertical plates 170*a*, 170*b*. At the lower ends 107*a*, 107*b*, plates 172*a*, 172*b* have also been provided at the front, through which attachment pins 108*a*, 108*b* may extend for securing the shank 106 to the fluke 102. More to the rear at the lower end 107*a*, 107*b* of the shank 106, lips 171*a*, 171*b* provided with several holes have been provided, so that with the help of pins 109*a*, 109*b* the shank can be attached to the fluke at various angled positions. Here, the position is shown in which the angle between the shank and the fluke is the largest.

Between the lower ends 107*a*, 107*b* of the shank legs 106, the upper surface 105 of the fluke 102 has a planar plane, which extends rearward from the front edge 103, between the shank legs, and ends in a transverse line, in order to merge into a kind of gate or mirror surfaces 162*a*, 162*b*, that are in one plane with each other. The normal N1 to the planes 162*a*, 162*b* is upwardly inclined oriented to the rear with respect to the fluke 102. The lower boundary of the planes 162*a*, 162*b* is somewhat V-shaped, in order to be contiguous to tunnel Y, to be further discussed, at the lower surface of the fluke 102. Outside of it the lower boundaries of the planes 172*a*, 172*b* are parallel to the upper boundary and therefore transverse to the plane of symmetry S of the anchor 101.

Apart from the lower ends 107*a*, 107*b* of the shank legs 106 the upper surface of the fluke 105 has side plates 160*a*, 160*b*, that run downwardly inclined to the side edge of the fluke, at an angle β of 10–40°, preferably 30°. As can be seen in FIG. 7A the side edges are parallel to each other and to the plane of symmetry S, and they form planar side planes 190*a*, 190*b*, that are also parallel to the plane of symmetry S.

The lower surface of the fluke 102 is built up from several plates, and, as can be seen in FIG. 7C, has a substantially inverted V-shape to form a kind of tunnel Y. Said tunnel is advantageous when hauling in the anchor upside-down over the roll of a supply vessel, because the anchor line that is still connected to the anchor and the object to be anchored, such as an oil rig, is centred somewhat then, so that the force as a result of the anchor line (many hundreds of metres long) sagging in the water can be exerted onto the anchor in a centred manner. To that end plates 183*a*, 183*b* are provided below the planar plane 161 of the upper fluke surfaces 105, which plates come together with the plate 161 at the front edge, and at the rear edge merge in the inclined lower edges of the surfaces 162*a*, 162*b*. For more rigidity a plate 184 can be arranged. Adjacent to it are longitudinal girders 150*a*, 150*b* to be further discussed, at the outside of which the lower surface 180 of the fluke 102 is continued outward in plates 185*a*, 185*b* that are inclined as well, of which the angle γ, as can be seen in FIG. 7C, is equal to that of the plates 183*a* and 183*b* and which may be 5–30. At the front end the plates of 185*a*, 185*b* merge into an edge with the plates 160*a*, 160*b* of the upper surfaces of the fluke 102. To the side, at the rear edges, the surfaces 185*a*, 185*b* merge into support surfaces 181*a*, 181*b*, that are situated in one plane with each other and of which the opposite of the normal N2 is at a rearward opening acute angle Í, considered in the plane of symmetry S, with respect to the line Q (FIG. 10) through the centre of gravity of the anchor and the point of engagement (pin 115) of the anchor line at the upper end of the shank, during lowering the anchor. The planes 181*a, b* end at the rear in transverse edges 188*a, b*, that also form the rear boundary of the planes 162*a, b* and are in line with each other, perpendicular to the longitudinal plane of symmetry S. This is further gone into in the discussion of the FIGS. 10A,B and 11.

At the side edges the surfaces 185*a, b* connect to stabiliser planes 182*a*, 182*b* which with their normals N3 are oriented towards each other, forward and downward. The arrangement with the stabiliser planes 182*a*, 182*b* and the side planes 190*a*, 190*b* as well as the portions of the support surfaces 181, 181*b* situated at the rear thereof, provide a solid structure at that location. Also see FIG. 8.

The longitudinal girders 150*a*, 150*b* (also see FIG. 8) are each built up from two longitudinal plates 151*a*, 152*a* and 151*b*, 152*b*, respectively. Between them they determine slit-shaped passages 153*a*, 153*b*, that are parallel to each other and to the plane of symmetry S. They accommodate hinge plates 172*a*, 172*b* and lips 171*a*, 171*b* in between them and form accommodation space 155 (see FIGS. 8 and 9), in which a penetration tooth 156 can attachedly be accommodated. The longitudinal plates are provided with a front lower edge portion 154*a, b* and a rear lower edge portion 157*a*, 157*b*, respectively, that is at an angle with respect to the front lower edge portion and runs more or less parallel to the upper surface 161 of the fluke 102.

Of each longitudinal girder both front lower edge portions 154*a*, 154*b* are connected to each other by means of strips 158*a, b*, which also downwardly limit the accommodation spaces 155.

The angles between the plates 160*a*, 160*b* and 161 on the one hand and the plates 183*a, b* and 185*a, b* on the other hand, measured from the front edge 103 in a cross-sectional plane parallel to the plane of symmetry S, is always constant. Said angle can be determined depending on the soil type, and preferably is between 0° and 20°, preferably 10°.

The moment of coming down of the anchor 101 on an anchoring bottom 200 is shown in FIG. 10A, in this example planar and horizontal. During lowering the line Q (see FIG. 10B) is vertical because of the pin 115 and the centre of gravity Z, and the support surfaces 181*a*, 181*b* with their normals N2 are oriented downward to the right, as seen in the drawing.

The reference line Q is at an forwardly opening angle Í to the opposite of the normal N2. During lowering the edges 188*a, b* that are forming a vertex line between the planes 162*a, b* and 181*a, b* are situated at the right—as seen in the drawing—, that is to say behind the line Q and therefore the centre of gravity Z, in which the penetration side or front side of the fluke is situated at the left. When coming down the anchor 101 will first come to support on the edges 188*a*, 188*b*, in which due to the forward position of the centre of gravity the anchor 101 will tilt forward. The support surfaces 181*a*, 181*b* prevent an all to deep penetration into the bottom, as a result of which the tilting might otherwise be impeded. In the situation shown in FIG. 10B, the line Q is already tilted somewhat to the left and will tilt further to the position shown in FIG. 11.

In FIG. 11 the anchor 101 is shown, in which the shank is adjusted at an angle for penetration in sand, with the smallest possible shank angle (the largest angle is for mud). The shank 106 here extends in the direction H, parallel to the ground surface 200. In this position the anchor rests on the front tips as well as on the lower edges of the side planes 190*a, b*. The upper end of the shank legs is at a distance of the basis. This situation can also be realised on deck, which facilitates mounting actions at the shank end. From the front edge 103 the upper surface 160*a*, 160*b* is at an angle α, seen in the cross-sectional plane parallel to the plane of symmetry S, of 25° to the floor area. The lower surface 185*a, b* is at an angle δ of 10° to the upper surface.

The invention claimed is:

1. Anchor fluke having attachment holes for receiving securing bolts in order to attach a lower end of an anchor shank to the fluke, said fluke having a longitudinal plane of symmetry, said holes comprising first and second holes located on either side of said longitudinal plane of symmetry so as to attach the shank to the fluke on locations spaced apart from each other in a direction transverse to said longitudinal plane of symmetry, in which the fluke has an upper surface at the location of the attachment holes that is a substantially planar centre plane that is perpendicular to said longitudinal plane of symmetry of the anchor and extends from the location of said first holes to the location of said second holes, in which the upper surface of the fluke forms side planes that run oblique from the location of the first and second holes to the side and downwards.

2. Anchor fluke according to claim 1, wherein said fluke upper surface has a front edge and a rear edge, wherein said upper surface is continuous from the front edge to the rear edge of the fluke.

3. Anchor fluke according to claim 1, wherein said side planes are planar.

4. Anchor fluke according to claim 1, wherein the centre plane and the side planes meet one another along respective lines that are parallel to said longitudinal plane of symmetry.

5. Anchor fluke according to claim 1, in which the anchor is box-shaped.

6. Anchor fluke according to claim 5, in which the fluke has a lower surface which in the area underneath the aforementioned planar plane of the upper surface comprises two planes that incline sideward and downward and meet according to a top line that is situated in a longitudinal plane of symmetry of the anchor.

7. Anchor fluke according to claim 6, in which the lower surface of the fluke is continued to the side, up to the side edges in planes running obliquely downward.

8. Anchor fluke according to claim 1, in which the fluke, considered in a sectional plane perpendicular to the longitudinal plane of symmetry, has an inverted V-shape.

9. Anchor fluke according to claim 1, in which the fluke forms a hollow body of plates and has an upper surface and a lower surface, which from front to rear diverge with respect to each other, considered in a longitudinal sectional plane, to a rear side of the fluke, in which in the outermost laterally situated areas of the fluke lateral planes have been formed having a normal that is substantially perpendicular to a longitudinal plane of symmetry of the anchor.

10. Anchor fluke according to claim 9, in which contiguous to the lateral planes stabiliser planes that are obliquely inwardly and downwardly oriented have been formed in the lower surface of the fluke.

11. In an anchor comprising a fluke and a shank extendable upwards and forward from the fluke, which shank at a first end is attached to the fluke and at a second end that is opposite the first end is adapted for connection to a penetration or anchor line, the improvements in which the fluke has a lower side and a lower side support surface for supporting the lower side of the fluke according to the lower side support surface, and structure for fixing the shank in an orientation in which the shank extends towards the second end substantially parallel to the lower side support surface.

12. Anchor according to claim 11, in which the shank comprises two cranked shank legs that converge to the second end.

13. Anchor according to claim 11, in which the fluke has an upper surface, which at the front considered in a vertical longitudinal sectional plane is at an angle of approximately 10–30° to the support surface.

14. Anchor having a fluke and a rigid shank extending upwards and forward from the fluke, which shank at a first end is attached to the fluke and at a second end that is situated opposite to the first end, is adapted for connection to a penetration line or anchor line, in which the fluke forms a hollow body of plates and has an upper surface and a lower surface, which from front to rear diverge with respect to each other, considered in a longitudinal sectional plane, to a rear side of the fluke, in which the anchor has a reference line running through the centre of gravity of the anchor and through the point of force application of the penetration line on the second end of the shank, in which the rear side of the fluke at the lower side is provided with transverse edges, that are situated rearward from the reference line.

15. Anchor according to claim 14, in which the transverse edges are situated on both sides of the longitudinal plane of symmetry of the anchor and are in line with each other.

16. Anchor according to claim 14, in which the transverse edges form the rear boundary of support surfaces that are part of the lower surface of the fluke, of which surfaces the opposite of the normal is at an angle to the reference line, which angle opens in rearward direction of the anchor.

17. Anchor according to claim 14, in which the fluke forms a hollow body of plates and has an upper surface and a lower surface, which from front to rear diverge with respect to each other, considered in a longitudinal sectional plane, to a rear side of the fluke, in which the rear side of the fluke forms planes, which are oriented obliquely rearward and upward when the fluke is placed on a level base.

18. Anchor comprising a fluke and a shank extending upwards and forward from the fluke, which shank at a first end is attached to the fluke and at a second end that is situated opposite to the first end, is provided with means for attachment of the anchor to a penetration line or anchor line, in which the shank is rigid and comprises two shank legs, in which the fluke has an upper surface at the location of the first end of the shank that is a substantially planar centre plane that is perpendicular to a longitudinal plane of symmetry of the anchor, in which the upper surface of the fluke forms side planes that run oblique to the side and downwards.

19. Anchor according to claim 18, wherein the planar centre plane extends from the first end of one of the shank legs to the first end of the other of the shank legs.

20. Anchor according to claim 18, wherein said fluke upper surface has a front edge and a rear edge, wherein said upper surface is continuous from the front edge to the rear edge of the fluke.

21. Anchor according to claim 18, wherein said side planes are planar.

22. Anchor according to claim 21, wherein said side planes each have a normal having a directional component, wherein the horizontal directional components of the normals of both side planes are oriented opposite to one another.

23. Anchor according to claim 18, wherein the centre plane and the side planes meet one another along respective lines that are parallel to said longitudinal plane of symmetry.

24. Anchor according to claim 13, wherein the angle is at least one of 20–30° or approximately 25°.

25. Anchor according to claim 16, in which at least one of the support surfaces are situated on both sides of the longitudinal plane of symmetry of the anchor, at a distance from the longitudinal plane of symmetry, or contiguous to the side edges of the fluke.

26. Anchor according to claim 3, wherein said side planes each have a normal having a directional component, wherein the horizontal directional components of the normals of both side planes are oriented opposite to one another.

* * * * *